United States Patent [19]

Freel et al.

[11] 4,303,127

[45] Dec. 1, 1981

[54] MULTISTAGE CLEAN-UP OF PRODUCT GAS FROM UNDERGROUND COAL GASIFICATION

[75] Inventors: John Freel, Oakmont; John C. Montagna, Pittsburgh; Seh M. Ryu, Murrysville, all of Pa.

[73] Assignee: Gulf Research & Development Company, Pittsburgh, Pa.

[21] Appl. No.: 120,153

[22] Filed: Feb. 11, 1980

[51] Int. Cl.[3] ..... C10J 5/00

[52] U.S. Cl. ..... 166/266; 55/27; 55/80; 166/267; 48/210; 48/DIG. 6

[58] Field of Search ..... 48/197 R, 203, 206, 48/210, DIG. 6; 55/23, 27, 28, 30, 80; 166/266, 267

[56] References Cited

U.S. PATENT DOCUMENTS

| | | | |
|---|---|---|---|
| 2,297,062 | 9/1942 | McKee | 55/27 |
| 2,591,595 | 4/1952 | Ogorzaly et al. | 48/210 |
| 3,310,109 | 3/1967 | Marx et al. | 166/266 |
| 3,480,082 | 11/1969 | Gilliland | 166/267 |
| 3,999,607 | 12/1976 | Pennington et al. | 48/DIG. 6 |
| 4,065,273 | 12/1977 | Rudolph | 48/206 |
| 4,078,041 | 3/1978 | Morris | 55/2 |
| 4,087,130 | 4/1977 | Garrett | 299/2 |
| 4,089,372 | 11/1978 | Terry | 166/256 |
| 4,114,688 | 9/1978 | Terry | 48/DIG. 6 |

OTHER PUBLICATIONS

Atherton et al.; "Aspects of Gas Processing and Integration for Power Generation from UCG", 4th UCG Annual Symp., 1978.

Zieve et al.; "Electrofluidized Bed in Filtration of Smoke Emissions from Asphaltic Pavement Recycling Processes", Env. Science and Tech., 12 No. 1 (96), 1978.

*Primary Examiner*—Peter F. Kratz

*Attorney, Agent, or Firm*—Deane E. Keith; Forrest D. Stine; Richard C. Gaffney

[57] ABSTRACT

The present invention provides a multistage process for the removal of tar, water and particulate contaminants from a hot product gas resulting from the in-situ gasification of an underground coal deposit, which comprises passing the hot product gas through a first heat exchange zone in indirect heat exchange relationship with a gasification gas to thereby sufficiently reduce the temperature of the product gas so as to separate the tar present in the product gas and provide a substantially tar-free product gas. Thereafter, the tar-free product gas is withdrawn from the first heat exchange zone and passed through at least one subsequent heat exchange zone in indirect or direct heat exchange relationship with a heat exchange material which has a lower temperature than the product gas. A major portion of the water originally present in the hot product gas is removed in the subsequent heat exchange zone. The gasification gas, used to cool the hot product stream by means of indirect heat exchange, is passed to an underground coal deposit and utilized therein to gasify the same. A fluidized bed heat exchanger may be used in the first heat exchange zone in order to substantially completely remove tar and particulate contaminants.

20 Claims, 3 Drawing Figures

MULTISTAGE CLEAN-UP OF PRODUCT GAS FROM UNDERGROUND COAL GASIFICATION

FIELD OF THE INVENTION

This invention relates to a process for the removal of contaminants from a hot product gas resulting from the in-situ gasification of underground coal deposits and to a multistage separation process wherein the separation in each stage may be effected by means of indirect heat exchange.

More particularly, this invention relates to a separation process wherein product gas and gasification gas are heat exchanged in a stage-wise manner to separately remove selected contaminants from the product gas.

DESCRIPTION OF THE PRIOR ART

Underground coal gasification (UCG) has been the subject of considerable attention and effort as a means to provide fuel gases for the generation of electric power and feed gases for the manufacture of liquid hydrocarbons by means of the Fischer-Tropsch and similar processes. The hot product gas resulting from the in-situ gasification of an underground coal deposit contains carbon monoxide and hydrogen in relatively high concentrations. However, the raw product gas also contains contaminants including particulates, such as ash in an amount of about 0.01 to about 1 grains/st-.cu.ft.; trace metals such as alkali; heavy condensable hydrocarbons including tars in an amount of about 0.5 to 2 percent by volume and light hydrocarbon oils in an amount of about 0.5 to about 2 percent by volume when light and heavy hydrocarbons are gaseous; gaseous water in an amount of about 5 percent to about 25 percent by volume; and gaseous sulfur and nitrogen contaminants. The particulate and tar contaminants can harm the equipment utilized to extract useful energy from the product gas and the equipment utilized to produce organic chemicals from the product gas. Additionally, the sulfur and nitrogen contaminants result in environmental pollution. Accordingly, it is necessary that these contaminants be removed from the product gas prior to its use.

It has been proposed to contact the hot product gas with a stream of water in order to cool the gas, remove particulates and condense hydrocarbons and water. Thereafter, the cooled gas would be contacted in a packed tower absorber and/or a scrubber in order to remove the sulfur and nitrogen contaminants. However, the use of such system would result in an additional anti-pollution problem, i.e., treating the water stream from the gas clean-up facility in order that it meet emission requirements.

Thus, it would be desirable to provide a process for treating the UCG hot product gas in order to remove contaminants therefrom wherein tar and particulate contaminants are removed separately from the water in the product gas and wherein useful thermal energy is recovered from the hot product gas.

SUMMARY OF THE INVENTION

According to the present invention, a multistage process is provided for the removal of tar, water and particulate contaminants from a hot product gas resulting from the in-situ gasification of an underground coal deposit, which process comprises passing the hot product gas through a first heat exchange zone in indirect heat exchange relationship with a heat exchange material, preferably a gasification gas, prior to its injection into an underground coal deposit for gasification of such deposit. The temperature of the product gas is thereby sufficiently reduced so as to cause the tar present in the product gas to separate therefrom and thus provide a substantially tar-free product gas and a substantially water-free tar product. Particulate contaminants in the hot product gas may be removed prior to the first heat exchange zone, or along with the tar in the first exchange zone, as hereinafter described. Thereafter, the tar-free product gas is withdrawn from the first heat exchange zone and passed through at least one subsequent heat exchange zone in direct or indirect heat exchange relationship with a second heat exchange material, preferably a second portion of gasification gas which has a lower temperature than the gasification gas in the first heat exchange zone. A major portion of the water originally present in the hot product gas is removed along with nitrogen contaminants present as ammonia, in the second heat exchange zone. A substantially water-free product gas is withdrawn from the second heat exchange zone and may then be conventionally treated to remove sulfur and remaining nitrogen contaminants, if desired, or used directly to provide energy or organic chemicals.

Contamination of the aqueous effluent produced in the second heat exchange zone is minimized, since tars have been previously removed. The heated gasification gas is passed to an underground coal deposit and utilized therein to gasify the same according to conventional UCG practice.

According to another embodiment of the present invention a fluidized bed heat exchanger is utilized for the first heat exchange zone thereby providing effective removal of particulate contaminants and tar without fouling of the heat exchange surface. Additionally, a fluidized bed heat exchanger may be used in all or any of the heat exchange zones to provide a more efficient heat exchange operation.

In still another embodiment of the present invention, the second heat exchange zone may comprise multiple heat exchange stages. Thus, three-stage heat exchange stages may be utilized in the process of the present invention. In the first stage, tar is removed from the hot product gas. In the next stage light hydrocarbon oils are removed, and in a third stage, water and additional light hydrocarbon oils are removed.

The tar and water contaminants recovered from the hot product gas by means of the present invention may be reinjected into an underground coal gasification operation, if desired.

DETAILED DESCRIPTION OF THE PREFERRED EMBODIMENTS

Figure 1:
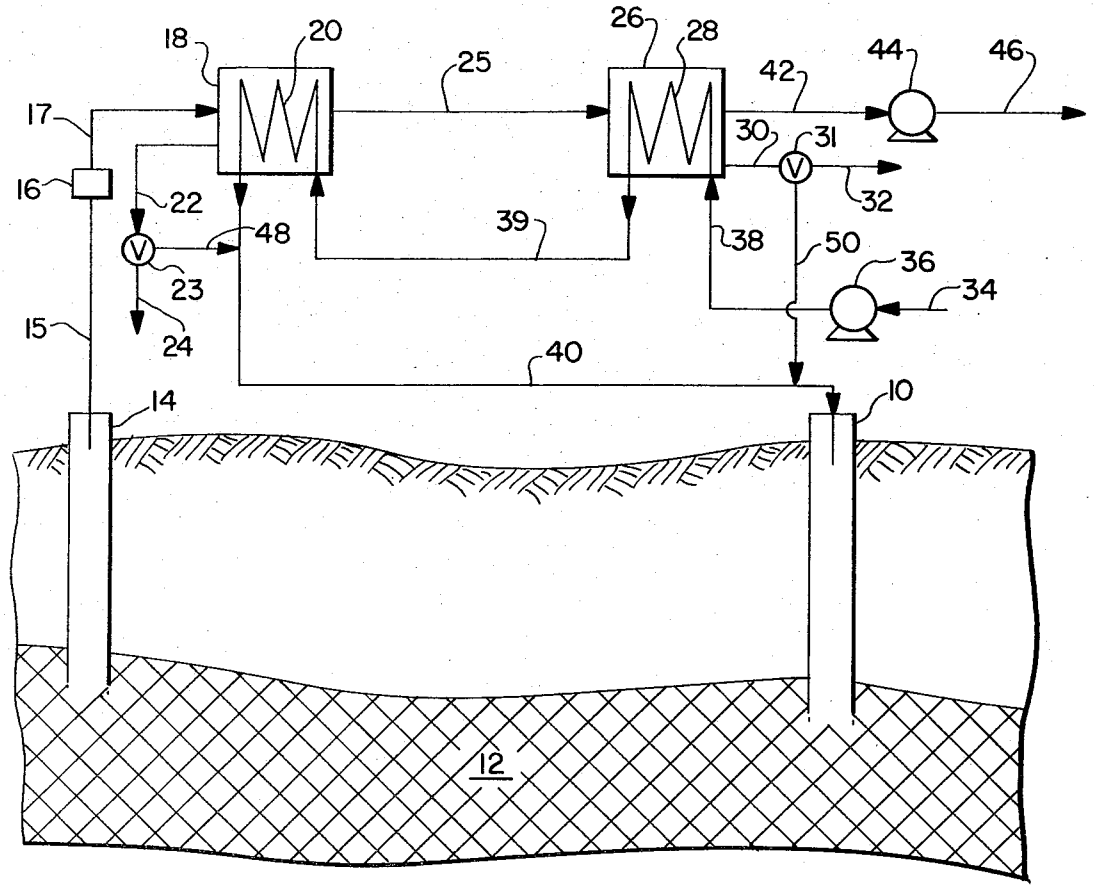
FIG. 1 is a diagrammatic illustration of a two-stage process for the separation of contaminants from a hot product gas resulting from the underground gasification of coal wherein two heat exchangers are utilized.

Referring to FIG. 1, an underground coal gasification process is shown including injection well 10, a coal deposit having a fractured zone 12 and production well 14. A variety of underground coal gasification operations are conventional and include the provision of tunnels and barriers within a coal deposit to provide communication between injection and production wells; the use of hydraulic or pneumatic pressure to fracture the coal between bore holes; the use of electrodes between which an electric current can be passed to carbonize the coal and create a permeable channel; the use of explosives to shatter the coal between bore holes; the use of nuclear devices to create shattered zones of high permeability; the use of directional drilling to establish underground passageways between bore holes spaced some distance apart at the earth's surface; or the injection of acids or other chemicals into coal seams to react with the coal and create zones of relatively high permeability through which gases can be subsequently passed. A gasification gas is injected into injection bore hole 10 and operation of the underground coal gasification process is initiated by the creation of a combustion front within the coal gasification zone 12. Hot gases are produced and are removed through production well 14 generally at a temperature in the range of about 600° F. (316° C.) to about 1000° F. (538° C.) and are passed by means of line 15 into a separation zone 16 in which solid particulate material is removed from the hot gas by any suitable means, including filters, cyclones or the like. The gas is then passed by means of line 17 to a first heat exchange zone 18.

In heat exchange zone 18 the hot product gas is passed countercurrently in indirect heat exchange relationship with a heat exchange material, such as the gasification gas in line 20. The term "gasification gas" is used herein to mean those gases injected into an underground coal gasification operation to support the gasification of the underground coal deposit. As is known to those skilled in the art, such gases include oxygen or air with or without water, i.e., present as steam, and additionally may comprise carbon dioxide. It has been proposed to gasify underground coal deposits utilizing carbon dioxide, alone. Thus, for the purposes of this invention a gasification gas may be any of the above gases, either alone or in combination, when utilized in an underground coal gasification operation. In zone 18 the temperature of the product gas is lowered to below about 450° F. (232° C.), preferably to about 200° F. (93° C.) so as to condense the tar present in the product gas. Condensed tar and occluded water are withdrawn through line 22. The term "tar" is utilized herein to mean coal derived, dark and thick hydrocarbon fractions which are heavier than water and are solid or semisolid at room temperature, i.e., 72° F. (22° C.).

The temperature and pressure conditions utilized in heat exchanger 18 are preferably controlled so that substantially all of the tar is condensed, but only a minimum amount of the water present is removed by means of line 22. The tar may be then passed through valve 23 to line 24 for disposition as hereinafter described.

The indirect heat exchange apparatus utilized in zone 18 may be of any conventional type such as, for instance, a shell and tube heat exchanger. However, according to another embodiment of the present invention at least the first heat exchange zone will comprise a fluidized bed type heat exchange apparatus as shown in FIG. 2.

Figure 2:
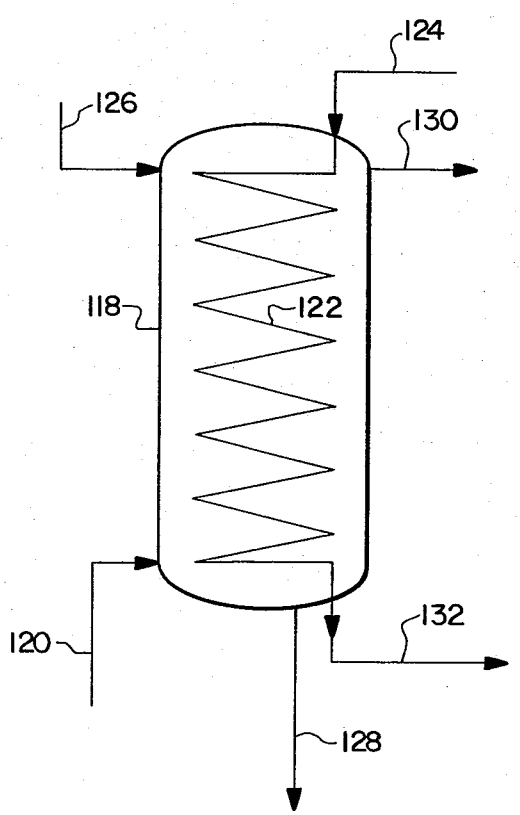
FIG. 2 illustrates heat exchanging the hot product gas with the gasification gas in a fluidized bed heat exchanger.

Referring now to FIG. 2, fluidized bed 118 contains fluidized inert contact materials, such as sand, which directly contact the hot product gas which is introduced by means of line 120. The fluidized bed 118 is provided with cooling means such as pipes or fin type coolers 122 projecting into the fluidized bed. A heat exchange material, such as gasification gas, introduced through line 124 is passed through the pipes or fins 122 in order to provide cooling of the fluidized bed by means of indirect heat exchange contact between the gasification gas and the hot product gas.

The use of such a fluidized bed heat exchanger provides continual cleaning of the internal surfaces of the heat exchanger due to the abrasive action of the fluidized inert particles. Accordingly, the tar condensed in the first heat exchange zone will not foul the internal surfaces of the heat exchanger. Additionally, the use of a fluidized bed heat exchanger provides for the continuous removal of particulate contaminants in the first heat exchange zone, since the tar condenses on the inert fluidized particles thereby promoting the removal of the particulate contaminants. Thus, if a fluidized bed heat exchanger is used, particulates separator zone 16 may be eliminated, if desired. The fluidized bed heat exchanger provides improved heat exchange contact between the gasification gas and the hot product gas. Since the temperature of the hot product gases from the underground coal gasification is relatively low, i.e., between about 600° F. (316° C.) and about 1000° F. (538° C.), the difference in temperature of the hot product gases from the underground coal gasification are relatively low, i.e., between about 600° F. and about 800° F., the difference in temperature between the gasification gas and the hot product gas is relatively small. By utilizing a fluidized bed type heat exchanger, indirect heat exchange contact between the product gas and the gasification gas is maximized thereby providing a more efficient cooling of the hot product gas and a more efficient heating of the cooler gasification gas.

Particulate contact material, e.g., sand, is admitted to fluidized bed heat exchange zone 118 through line 126 and separated tars, oils and some water, are withdrawn through line 128 along with the contact material. It may be desirable to continuously remove the contaminated particulate contact material through line 128 and continuously admit contact material through line 126. The contaminated contact material is passed to a treatment zone (not shown) wherein the separated material is removed. Removal of the separated tars and particulate contaminants may be effected by any suitable means such as burning or hot solvent treatment. Accordingly, the tar present on the particulate contact material may either be recovered or burned so as to provide further thermal energy. A substantially tar-free product gas is withdrawn through line 130 and passed to further treatment. The gasification gas used as the indirect heat exchange material is withdrawn through line 132 and preferably introduced into an underground coal gasification zone.

Fluidized bed heat exchange apparatus 118 may be any of the conventional types known to those skilled in the art. One such apparatus is described in U.S. Pat. No. 3,443,360 to Reeves which is hereby incorporated by reference. When such an apparatus is utilized, fluidization of the inert particulate materials is accomplished by means of the hot product gas. The fluidization material may also be chemically active (e.g., iron oxides) towards gaseous sulfur contaminants. Alternatively, an electrofluidized bed of the type disclosed in U.S. Pat. No. 4,078,041 to Morris can be utilized, which patent is hereby incorporated by reference. Use of such electrofluidized bed involves an electrical field which aids in the precipitation of solid particulate contaminants onto the fluidization material.

Referring again to FIG. 1, a tar-free product gas is withdrawn from first heat exchange zone 18 via line 25. The hot product gas in line 25 is at a temperature of less than about 450° F. (232° C.), preferably about 200° F. (93° C.). The hot product gas is passed to second heat exchange zone 26 wherein the temperature is further reduced to between about 50° F. (10° C.) and 150° F. (66° C.), preferably between about 100° F. (38° C.) and 135° F. (57° C.), due to indirect heat exchange contact with a second portion of the gasification gas in line 28. The particular temperatures utilized in the various heat exchange zones will vary depending upon the nature of the particular product gas being treated. A major portion of the water originally present in the hot product gas is thereby condensed. Preferably, substantially all of the water originally in the hot product gas is separated from the product gas in the second heat exchange zone 26. By separating the tar and the water from the product gas in separate heat exchange zones, zones 18 and 26, respectfully, contamination of the water with tar is minimized or eliminated.

Additionally, low boiling hydrocarbon oils are condensed within heat exchange zone 26. The hydrocarbon oils and water may be withdrawn through line 30, valve 31 and line 32.

It is also preferred that the second heat exchange zone 26 comprises a fluidized bed heat exchanger of the type shown in FIG. 2 in order that the added efficiency of this type of heat exchanger be realized in the second heat exchange zone.

A gasification gas, such as air, is introduced into zone 26 by means of line 34 from which the gas is passed through compressor 36 to increase the pressure thereof and thereafter passed by means of line 38 into line 28 wherein the temperature of the gasification gas is raised thereby cooling the tar-free hot product gas in heat exchange zone 26. The gasification gas, now at a higher temperature, is withdrawn from heat exchange zone 26 through line 39 and passed to line 20 which is in first heat exchange zone 18. The gasification gas is withdrawn from the first heat exchange zone through line 40 at a temperature of about 600° F. (316° C.). The thus pre-heated gasification gas is thereafter injected into injection well 10 and utilized in the underground gasification of fractured coal seam 12.

A substantially water-free, oil-free, and particulate-free product gas is withdrawn from the second heat exchange zone 26 through line 42. The product gas is at a temperature of between about 50° F. (10° C.) and 150° F. (66° C.) and is passed through compressor 44 wherein the pressure is suitably increased to a desired pipeline pressure depending upon the end use of the product, and then withdrawn by line 46. If sulfur and nitrogen gaseous contaminants have not been previously removed in the first and second heat exchange zones, the product gas can be passed to conventional scrubbers, etc. (not shown) wherein the contaminants can be removed without fouling of the scrubbers by tars and particulates. Preferably, the gas withdrawn through line 46 is free of nitrogen contaminants, such as ammonia, with the ammonia having been removed with the water in line 32.

If desired, the tar and/or oils and water recovered from the first and second heat exchange zones 18 and 26 may be reinjected into an underground coal gasification zone. Thus, the tar withdrawn from zone 18 may be passed by means of three-way valve 23 and line 48 to line 40 for reinjection into well 10. Likewise, the hydrocarbon oils and water withdrawn from zone 26 may be passed through three-way valve 31 and line 50 to line 40 for reinjection into well 10. Reinjection of the hydrocarbons, such as the tar, results in the recovery of energy from the tar, while reinjection of the water will obviate the need to treat the water in order to remove pollutants therefrom.

Depending of the nature of the coal seam being subjected to in-situ gasification, it may or may not be practical to reinject all of the water recovered from the second heat exchange zone 26. Thus, in certain dry Western coal seams the entire UCG process will result in a negative production of water, i.e., it will be necessary to provide water from an outside source in order to carry out the in-situ gasification of the underground coal seam. In such an instance, an added benefit of reinjecting the water recovered will be a reduction in the amount of water that need be provided from an outside source. However, where a relatively "wet" seam of coal is to be gasified, only minimal amounts of water may need be injected into the underground coal gasification operation in order to carry out the same. In such a case, it will be practical only to reintroduce a minor portion of the water recovered in the second indirect heat exchange zone.

Alternatively, the gasification gas from the first heat exchange zone 18 may be directly passed to a UCG process (by a means not shown). Likewise, a material such as water or ambient air can be used as a heat exchange material in place of a gasification gas in the second heat exchange zone 26. Another alternative is to exchange the heat directly with recirculated product water in a second heat exchange zone in place of zone 26 (by a means not shown).

Figure 3:
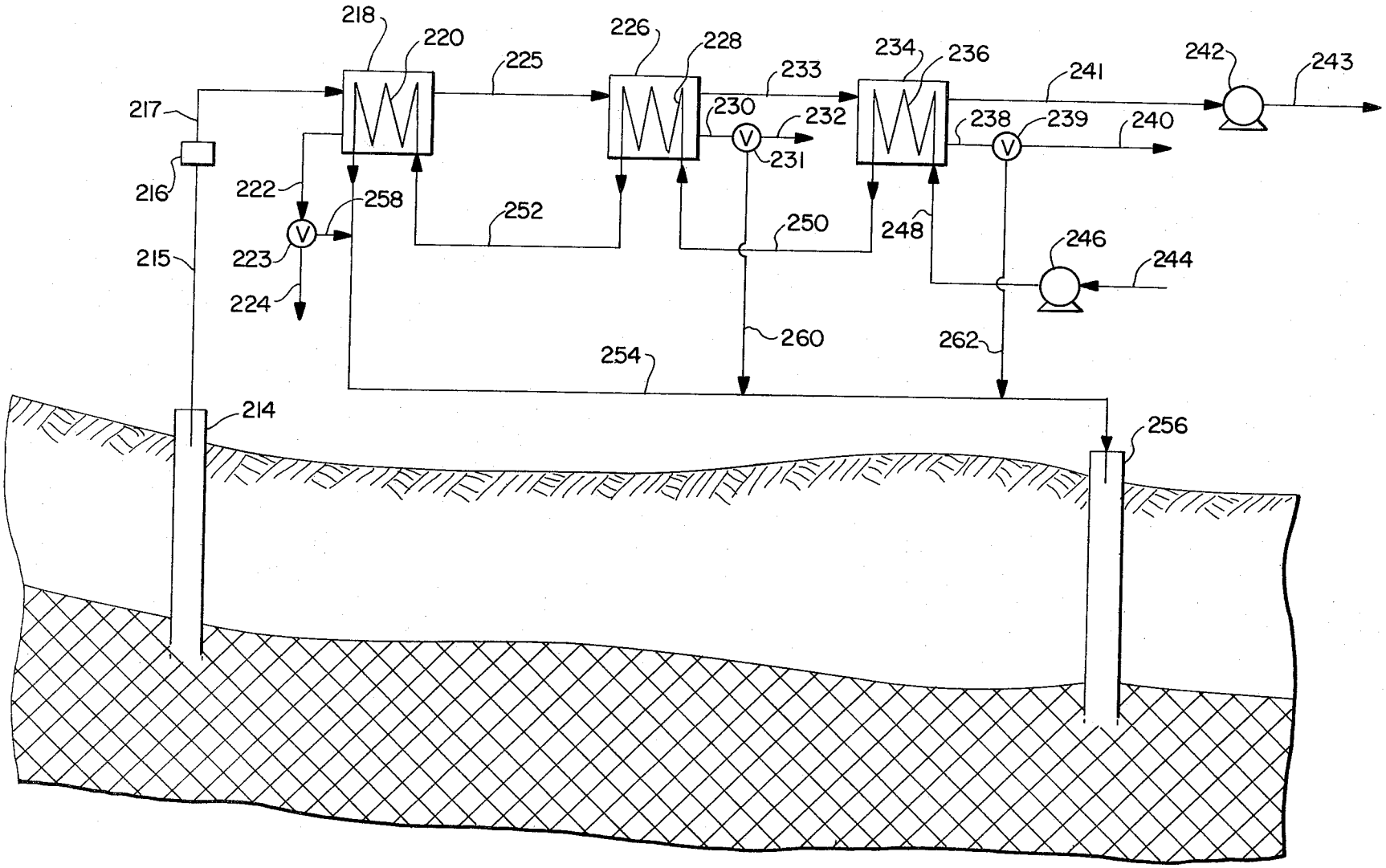
FIG. 3 is a diagrammatic illustration of a three-stage heat exchange process of the present invention.

Referring to FIG. 3, a three-stage heat exchange system is depicted. Hot product gas at a temperature of about 600° F. (316° C.) to about 1000° F. (538° C.) is passed from production well 214 by means of line 215 to filter 216 for removal of particulate material. The gas is then passed by means of line 217 into first heat exchange zone 218 in indirect heat exchange relationship with a gasification gas in line 220. The temperature of the hot product gas is reduced to below about 450° F. (232° C.), i.e., between about 225° F. (107° C.) and about 450° F. (232° C.), i.e., 250° F. (121° C.) in the first heat exchange zone so as to separate and condense the tar present in the hot produced gas. The temperature reduction in zone 218 is preferably insufficient to cause substantial separation of water. The separated tar is withdrawn through line 222. The first heat exchange zone 218 may comprise a fluidized bed heat exchanger as illustrated in FIG. 2. In such a case, particulate contaminants are also removed through line 222 with contaminated contact materials which are periodically or continuously removed through line 222, valve 223 and line 224 for suitable regeneration by means not shown.

A substantially tar-free product gas is withdrawn through line 225 at a temperature of below about 450° F. (232° C.) and passed into second heat exchange zone 226. In zone 226, the tar-free hot product gas is passed in indirect heat exchange relationship with a second portion of gasification gas in line 228 so as to further reduce the temperature of the product gas sufficiently to cause separation of a normally liquid hydrocarbon oil but insufficient to cause substantial separation of water, i.e., from about 155° F. (68° C.) to about 220° F. (104° C.), preferably about 200° F. (93° C.). A normally liquid hydrocarbon oil, i.e., a light hydrocarbon oil, is thereby separated in the second heat exchange zone and withdrawn through line 230, valve 231 and line 232. Preferably, the hydrocarbon oil is tar-free, particulate-free and water-free and will thus constitute a saleable product.

The second heat exchange zone 226 may comprise a fluidized bed heat exchanger as shown in FIG. 2. Accordingly, contaminated contact materials may also be removed through line 230, valve 231 and line 232 periodically for regeneration (by a means not shown). A cooler, tar-free product gas is withdrawn through line 233 at a temperature of about 200° F. (93° C.) and passed into third heat exchange zone 234 wherein it is passed in indirect heat exchange relationship with a third portion of gasification gas in line 236. The temperature of the cooler tar-free product gas is thereby further reduced to a temperature of about 50° F. (10° C.) to about 150° F. (66° C.), preferably from about 100° F. (38° C.) to about 125° F. (52° C.) so as to cause condensation of water present in the product gas. Preferably, a major amount of the water originally present in the hot product gas in line 215 is condensed in heat exchange zone 234 and withdrawn through line 238, valve 239 and line 240. Additionally, heat exchange zone 234 may be a conventional indirect heat exchange or a fluidized bed-type heat exchange zone. Nitrogen contaminants such as ammonia are removed with process water in heat exchange zone 234. Alternatively, a direct heat exchange zone employing recirculated process water may be substituted for heat exchange zone 234 (not shown). A substantially tar-free and water-free product gas is withdrawn through line 241, passed through compressor 242 to increase the pressure thereof and withdrawn by means of line 243. The product gas is preferably free of nitrogen contaminants, such as ammonia, such contaminants having been removed with the water in line 238.

The gasification gas used in the system illustrated in FIG. 3 is preferably an oxygen-containing gas introduced into zone 234 by means of line 244, compressor 246 and line 248 from which it is passed into line 236 wherein it is used as the heat exchange material in zone 234. The gasification gas is withdrawn from heat exchange zone 234 through line 250 and passed into line 228 in heat exchange zone 226. The gasification gas is withdrawn from heat exchange zone 226 through line 252 and passed into line 220 in heat exchange zone 218. A pre-heated gasification gas is thereafter withdrawn from heat exchange zone 218 through line 254 and passed via injection well 256 into the underground coal gasification operation.

As in the system shown in FIG. 1 at least a portion of the contaminants removed from the product gas may be reinjected into well 256. Thus, at least a portion of the tar removed by means of line 222 may be passed by means of three-way valve 254 and line 258 to join 254. Likewise, at least a portion of the normally liquid hydrocarbon oil in stream 230 can be passed through valve 231, line 260 and line 254 for reinjection to well 256. Similarly, at least a portion of the water containing stream 238 can be passed by means of valve 239, line 262 and line 254 for reinjection.

The use of heat exchange materials other than a gasification in heat exchange zones 226 and 234 is within the scope of the present invention. If desired, a heat exchange material such as water or ambient (non-process) air may be utilized in zones 226 and 234 and may be supplied from a source not shown. Additionally, a plurality of gasification gas streams from different sources may be used for heat exchange zones 218, 226 and 234.

The following examples illustrate the present invention, and are not intended to limit the invention, but rather, are being presented merely for purposes of illustration.

EXAMPLE 1

UCG gas was produced using air and water as the gasification gas. A sample of the raw UCG product gas was fed at a rate of 3.73 standard cubic feet per minute to an inertial impactor device (Anderson Impactor) followed by a glass-fiber filter for removal of the particulates at 570° F. (299° C.) and 75 psig (5.17 kg/cm$^2$) from the gas, which was at a similar temperature and pressure. After 35 minutes, a total of 0.37 gram of relatively dry and dark particulates was collected in the particulate collection device. This corresponded to a particulate loading of 0.05 grains/standard cubic feet of dry product UCG gas. The mean aerodynamic particle diameter was less than 1 $\mu$m. The particle sizes and loadings were obtained from a gravimetric analysis of the collected sample.

The following example illustrates the stage-wise separation procedure of the present invention.

EXAMPLE 2

A separate stream of the raw UCG product gas tested in Example 1 was passed at a flow rate of 2.6 standard cubic feet per minute through several product clean-up stages maintained at a pressure of about 75 psig (5.03 kg/cm$^2$).

In the first clean-up stage, solid particulates were removed by filtration at about 600° F. (316° C.), which was the temperature at which the UCG gas was produced.

After the solid particles were removed in the first stage, the resulting product gas was cooled to a temperature of 250° F. (121° C.) by indirect heat exchange resulting in the separation of heavy hydrocarbons in the form of tar from the UCG product gas. The tar sample that was removed was essentially water-free, heavier than water and solid at ambient temperature (about 60° F. or 16° C.). The amount of tar separated at 250° F. (121° C.) was 3.7 grains per standard cubic foot of dry UCG product gas.

The substantially tar-free product gas was then cooled by indirect heat exchange to a temperature of 130° F. (54° C.) causing the separation of lighter hydrocarbons and process water from the product gas. The resulting oil-water sample separated into two distinct phases thereby permitting the hydrocarbon oil to be readily decanted from the separated process water. The hydrocarbon oil was lighter in density than was the process water, and was liquid at 60° F. (16° C.). The amount of hydrocarbon oil separated at 130° F. (54° C.) was 4.1 grains per standard cubic feet of dry UCG product gas. The process water separated from the UCG product gas at 130° F. (54° C.) corresponded to 24 percent by volume of the raw UCG product gas.

The foregoing example demonstrates that by separately removing the heavy hydrocarbon (tar) from the product gas in a separate step, the remaining water and light hydrocarbon oil are easily separated from one another.

For purposes of comparison, the following example demonstrates the difficulty encountered when the heavy hydrocarbon (tar) is not separately removed from the product gas.

EXAMPLE 3

The procedure of Example 2 was followed using another sample of the same UCG product gas, with the exception that the liquid-gas separation stages were controlled so that a temperature of 185° F. (85° C.) was used in the first liquid-gas separation stage, rather than 250° F. (121° C.), while the second liquid-gas separation stage was conducted at 115° F. (46° C.), rather than at 130° F. (54° C.) as in Example 2.

Some of the hydrocarbons separated from the UCG product gas at 185° F. (85° C.) were heavier and some were lighter than the co-separated process water. The oil-water sample recovered at 185° F. (85° C.) contained three phases and separation and recovery of the tar, liquid hydrocarbons and water, respectively, was difficult. Decantation was much more difficult for the 185° F. (85° C.) sample as compared with the two-phase sample obtained at 115° F. (46° C.), or the two-phase sample obtained at 130° F. (54° C.) in Example 2.

Based upon the results of the foregoing examples, it appears that when the heavy hydrocarbon tar is not separated initially from the light hydrocarbon and process water, an emulsion-type system forms, rendering the separation of the various phases more difficult. Thus, although the tar has a specific gravity (approximately 1.2) which is higher than that of water, and the oil has a specific gravity (approximately 0.8–0.9) which is less than that of water, the mixture of these two hydrocarbon materials appears to have a specific gravity approximating water (1.0). However, if the tar is separately removed, the resulting lighter hydrocarbon process water admixture will separate readily into two distinct phases thereby making recovery of each component much easier.

Although the invention has been described in considerable detail with particular reference to certain preferred embodiments thereof, variations and modifications can be effected within the spirit and scope of the invention as described hereinbefore, and as defined in the appended claims.

What is claimed is:

1. A multistage process for the separation of contaminants from a hot product gas resulting from in-situ gasification of underground coal deposits in an underground coal gasification zone which comprises:

(a) passing said hot product gas through a first heat exchange zone in indirect, countercurrent heat exchange relationship with a first portion of gasification gas to reduce the temperature of said product gas to a temperature in the range of between about 200° F. and 450° F. and increase the temperature of said first portion of gasification gas so as to cause coal-derived tar present in said product gas to separate therefrom and provide a substantially tar-free product gas;

(b) withdrawing said substantially tar-free product gas from said first heat exchange zone and passing said substantially tar-free product gas through a second heat exchange zone in indirect heat exchange relationship with a second portion of said gasification gas so as to reduce the temperature of said substantially tar-free product gas to a temperature in the range of between 50° F. and 150° F. and increase the temperature of said second portion of said gasification gas and cause substantially all of said water present in said gas to condense and separate therefrom;

(c) withdrawing a substantially tar-free and water-free product gas from said second heat exchange zone; and (d) withdrawing said second portion of gasification gas of increased temperature from said second heat exchange zone and passing it to said first heat exchange zone thereby providing said first portion of gasification gas; and withdrawing said first portion of gasification gas of increased temperature from said first heat exchange zone and passing it to an underground coal gasification zone.

2. The process of claim 1, wherein ammonia is separated in said second heat exchange zone.

3. The process of claim 1, wherein said first heat exchange zone comprises a fluidized bed heat exchanger.

4. The process of claim 3, wherein said second heat exchange zone is a fluidized bed heat exchanger.

5. The process of claim 3, wherein separated tar in said first heat exchange zone coats fluidized inert contact particles and thereby assists in the removal of said particulate contaminants.

6. The process of claim 3, wherein said first heat exchange zone contains chemically active contact materials capable of separating gaseous sulfur contaminants.

7. The process of claim 1, wherein said separated tar is introduced into an underground coal gasification zone.

8. The process of claim 1, wherein said separated water is introduced into an underground coal gasification zone.

9. The process of claim 1, wherein in said first heat exchange zone the temperature of said product gas is reduced to about 250° F.

10. A multistage process for the separation of contaminants from a hot product gas resulting from in-situ gasification of underground coal deposits in an underground coal gasification zone which comprises:

(a) passing said hot product gas through a first heat exchange zone in indirect heat exchange relationship with a first portion of gasification gas to reduce the temperature of said product gas to a temperature in the range of between about 225° F. and about 450° F. and increase the temperature of said first portion of gasification gas so as to cause the tar present in said product gas to separate therefrom and provide a first product gas which is substantially tar-free;

(b) withdrawing said first product gas from said first heat exchange zone and passing said first product gas through a second indirect heat exchange zone in indirect heat exchange relationship with a second portion of said gasification gas so as to lower the temperature of said first product gas to a temperature in the range of between about 155° F. and about 220° F. and increase the temperature of said second portion of said gasification gas and cause normally liquid hydrocarbon oil to separate from said first product gas and thereby provide a second product gas;

(c) withdrawing said second product gas from said second heat exchange zone and passing said second product gas through a third heat exchange zone in indirect heat exchange relationship with a third portion of said gasification gas so as to reduce the temperature of said second product gas to a temperature in the range of between about 50° F. and 150° F. and increase the temperature of said third portion of said gasification gas and cause water present in said second product gas to separate therefrom; and (d) withdrawing a third product gas which is substantially water-free from said third heat exchange zone;

wherein said third portion of gasification gas of increased temperature is withdrawn from said third heat exchange zone and passed to said second heat exchange zone thereby providing said second portion of gasification gas; said second portion of gasification gas of increased temperature is withdrawn from said second heat exchange zone and passed to said first heat exchange zone thereby providing said first portion of gasification gas and said first portion of gasification gas of increased temperature is withdrawn from said first heat exchange zone and injected into an underground gasification zone.

11. The process of claim 10, wherein ammonia and a major amount of the water present in said hot product gas is separated in said third heat exchange zone.

12. The process of claim 10, wherein substantially all of the water present in said hot product gas is separated in said third heat exchange zone.

13. The process of claim 10, wherein said first heat exchange zone comprises a fluidized bed heat exchanger.

14. The process of claim 13, wherein said second and third heat exchange zones comprise fluidized bed heat exchangers.

15. The process of claim 14, wherein said first heat exchange zone comprises a fluidized bed heat exchanger and contains chemically active contact material capable of separating gaseous sulfur contaminants.

16. The process of claim 10, wherein in said first heat exchange zone the temperature of said product gas is reduced to about 250° F.

17. A process for the separation of tar and particulate contaminants from a hot product gas resulting from the in-situ gasification of an underground coal deposit comprising;

introducing said hot product gas into a lower portion of a heat exchange zone and passing said hot product gas in direct, countercurrent heat exchange relationship with a gasification gas, said gasification gas being introduced into an upper portion of said heat exchange zone, to thereby reduce the temperature of said hot product gas to a temperature in the range of between about 200° F. and 400° F. and to increase the temperature of said gasification gas so as to condense substantially all of the tar present in said product gas, said heat exchange zone consisting essentially of a fluidized bed of inert or chemically active solid contact particles, said solid contact particles being extraneous solid particles introduced into an upper region of said heat exchange zone and withdrawn from a bottom region of said zone, said condensed tar coating said fluidized contact particles thereby assisting in the removal of particulate contaminants from said product gas;

withdrawing a substantially tar-free and substantially particulate-free product gas from said heat exchange zone and withdrawing said gasification gas of increased temperature from said heat exchange zone and introducing it into an underground coal gasification zone.

18. The process of claim 17 wherein said contact particles are continuously introduced into the upper portion of said heat exchange zone and continuously withdrawn from said lower portion of said heat exchange zone.

19. The process of claim 18, wherein said contact particles are inert.

20. The process of claim 19, wherein said contact particles comprise sand.

* * * * *